United States Patent [19]

Bonofiglo

[11] Patent Number: 4,993,614

[45] Date of Patent: Feb. 19, 1991

[54] POCKET MEMBER FOR TOOL BELT

[76] Inventor: William F. Bonofiglo, 2033 Coronado SE., Grand Rapids, Mich. 49506

[21] Appl. No.: 465,347

[22] Filed: Jan. 16, 1990

[51] Int. Cl.[5] ..... A45F 5/02

[52] U.S. Cl. ..... 224/253; 224/904; 224/224

[58] Field of Search ..... 224/904, 250, 251, 253, 224/254, 255, 223, 224, 240, 242, 246, 247, 203, 205, 901

[56] References Cited

U.S. PATENT DOCUMENTS

| | | | |
|---|---|---|---|
| 2,007,696 | 7/1935 | Siebert | 224/253 |
| 2,102,515 | 12/1937 | Connell | 224/255 |
| 2,682,981 | 7/1954 | Previdi | 224/253 |
| 2,758,798 | 8/1956 | Schmidt | 224/904 |
| 4,613,068 | 9/1986 | Bianchi | 224/242 |
| 4,804,121 | 2/1989 | Stanton et al. | 224/224 |

*Primary Examiner*—Henry J. Recla
*Assistant Examiner*—Keith Kupferschmid
*Attorney, Agent, or Firm*—Price, Heneveld, Cooper, DeWitt & Litton

[57] ABSTRACT

A tool belt is provided with one or more separate tool holding members, each capable of holding several tools. Each of the tool holding members is detachably secured to the belt whereby it can be removed and replaced by a substitute holding member of similar design equipped with different tools. The tool holding members can be an added accessory to existing belts as well as a feature for tool belts originally designed to utilize the detachable tool holder.

7 Claims, 1 Drawing Sheet

POCKET MEMBER FOR TOOL BELT

SUMMARY OF THE INVENTION

This invention relates to belt-type tool holders, such as are used by electricians, carpenters and the like. The tool holder is a strip which preferably is detachably secured to a conventional tool holder belt by detachable anchor means, such as snaps or Velcro type fastening tape. The tools are inserted in sockets formed by an elastic web having a size such that the tools can be readily inserted and removed but while in the socket are clamped by the elastic web material. Both the strip and the elastic web material have surfaces characterized by a high coefficient of friction.

BACKGROUND OF THE INVENTION

Many people, particularly in the construction and repair industries, have to have immediately available to them a number of tools to enable them to carry out their projects. A number of these persons have to have the tools quickly available because changing tools is a frequent requirement. Further, the economics of this type of activity do not allow the user unnecessarily to waste time changing from one tool to another.

The use of belts and belts with special pockets for tools have been available for many years. Depending upon the user's activities, the belts, or tool caddies, have a variety of designs for holding tools and materials. For tools, such as hammers, the most common facility are large loops through which the handle of a tool can be dropped and the tool will be held against falling through entirely because the head or some other feature of the tool is too large to pass through the loop. Smaller tools, such as screwdrivers, smaller wire cutters, chisels and the like are normally stored, as a group, in one or more large pockets. To retrieve a tool from one of these pockets, the contents of the pocket has to be carefully inspected by the user to be able to select the particular tool then needed. Further, these tool holding facilities are all made a permanent part of the tool belt and thus, are not capable of being modified to best adapt the tool belt to the particular needs of the user.

BRIEF DESCRIPTION OF THE INVENTION

This invention provides a means including a plurality of loops arranged side-by-side on a backing strip with each loop designed to hold only one tool. The backing strip is of a material having a textured surface facing the tool pockets created by the loops. The material forming the loops is resiliently stretchable and also has surface texture which generates a degree of resistance to tool removal to prevent inadvertent loss of the tool due to its slipping out of the pocket formed by the loop or pocket.

The backing strip to which the material forming the loops is secured, is detachably secured to the belt by suitable means. This provides several advantages among which are that a tool belt not having this type of facility can be modified by the owner to adapt it to use this type of tool holder. Also, it makes it possible for a user to have immediately available at the work site more than one grouping of tools. Thus, depending upon the requirements of the job he is undertaking, simply by substituting one tool holder and its tools for another with different tools the user is immediately prepared for the change in his activities. This is done without removal of the belt. Further, the invention makes it possible to do this independently on each side. It is also possible, by making the tool holder strips with tool holding pockets of different sizes, to adapt the basic tool holder belt, either initially or at the work site, to a much wider range of activities than has heretofore been possible with belts of known design and construction. All of this is possible without eliminating many of the presently provided pockets and facilities such as those for nails, measuring tapes, hammers and electric drills. It is very important that, when invention is used on a belt having the conventional pockets, the invention does not interfere with the accessibility of the pocket.

These advantages and others will be understood by those familiar with the design and use of conventional tool belts upon reading the following specification and drawings.

DESCRIPTION OF THE PREFERRED EMBODIMENT

Figure 2:
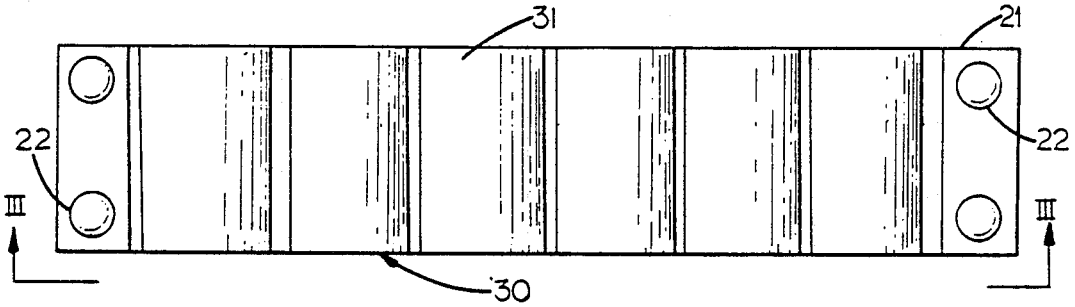
FIG. 2 is a fragmentary front view of the belt illustrated in FIG. 1, as it would appear laid out on a flat surface.
Figure 3:
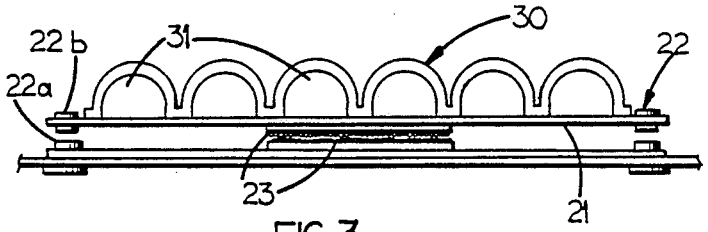
FIG. 3 is an enlarged elevation view of a tool holding facility for a belt incorporating this invention.
Figure 4:
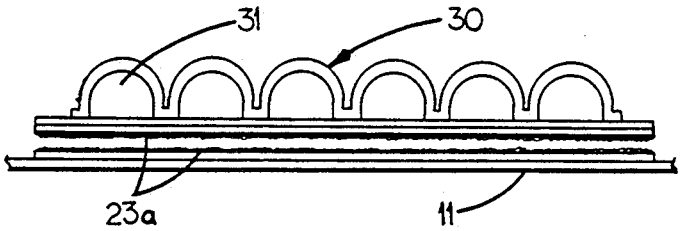
FIG. 4 is a view taken along the plane IV—IV of FIG. 3, including a fragmentary portion of the belt.

Referring to FIG. 2, a belt assembly 10 having a belt member 11 is equipped with pouches 12, 13 and 14 of various sizes. Pouches of this type are conventional and have been used for many years for holding tools and materials such as nails, staples, tapes and assorted tools. These pockets do not have facilities for separating their contents and, therefore, whenever a tool is to be removed from one of these pockets, it must first be identified among the other tools. This is a time consuming operation, particularly if the tool is small or is somewhat similar to other tools in the pocket such as may be the case, for example, between a pair of pliers and a pair of wire cutters. The use of this invention may eliminate the necessity for some of these pocket facilities or simply free them for uses other than storing tools.

Mounted on the belt are a pair of tool caddies 20. These are so mounted on the belt that they extend from a point adjacent the user's front partially around the side of the user. If no pouch, such as one of those identified as 12, 13 or 14 is used, attachment can be made directly to the belt. If a pouch is included, the attachment may be made through the flap of the pouch to the belt. Each tool caddy has a backing member 21, preferably of the same width as the belt member 11 and a length between one fourth and one half the length of the belt and designed to seat against or adjacent to and parallel with the belt member 11. It can either be immediately adjacent the belt or have the upper portion of one of the pockets, such as the pocket 12, interposed between it and the belt member 11. In either case, it is detachably secured to the belt 11. One way of doing this is to provide a pair of snap fasteners 22 at each end. These snap fasteners have one portion **22*a* secured to the belt 11 and the other portion 22*b* secured to the backing member 21**. Thus, the tool caddy can be quickly and easily secured to and removed from the tool belt, as needed.

To support the backing member against the weight of the tools between the fasteners, it is desirable to provide additional support belt. Suitable means for doing this could be one or more patches of Velcro type fastening tape 23.

Figure 1:
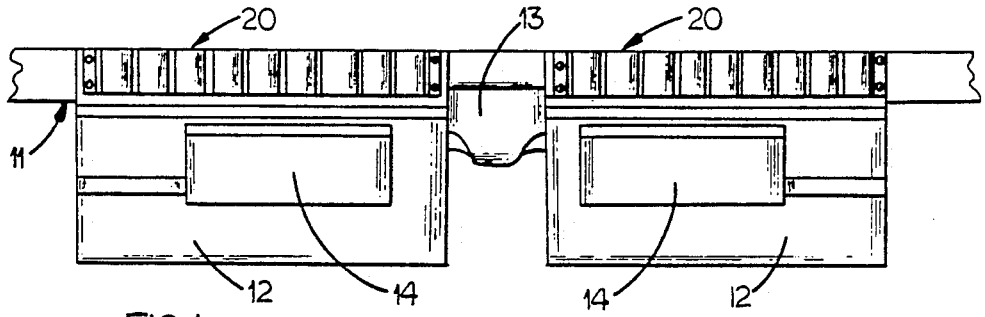
FIG. 1 is an oblique view of a tool belt modified to incorporate this invention.

It will be recognized that instead of the snap fasteners 22 and the patch of Velcro type fastening tape 23*a*, the tool caddy can be secured entirely by strips of Velcro type fastening material extending the length of the backing member as illustrated in FIG. 1. Particularly would this be satisfactory for situations involving the smaller or lighter weight tools.

Figure 5:
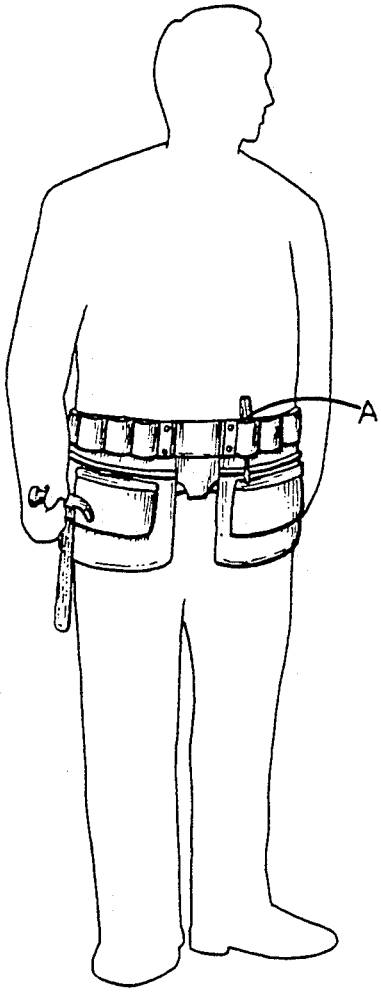
FIG. 5 is a view similar to FIG. 4 illustrating a modification of the attachment means for the invention.

Mounted to the outer face of the backing member 21 is a strip-like band 30 of elastic material which is sewn at each end and at spaced intervals to the backing member to create loop-like pockets 31, each designed to hold one tool. By this arrangement, the tools A each extend downwardly and are arranged in side-by-side order along the length of the caddy (FIG. 5). The size of the individual loops or pockets is such that while a portion of the tool will pass through the loop, the upper portion will not, thus, serving as a retainer and a means by which the user can grip the tool to either insert or withdraw it from a pocket. For this purpose, it is important that the outer surface of the backing strip have a rough or highly textured surface to provide the friction necessary to positively hold the tool against inadvertent displacement due to the body movements of the user. A material which has been found to be suitable for this purpose is a belting offered for sale by Michaels of Oregon Co., P.O. Box 13010, Portland, Oreg. 97213 as a 2-inch wide, heavy-duty, Nylon webbing under the trademark "Side Kick".

The elastic band material 30 forming the pockets is also a material having a surface which clamps against and frictionally grips whatever is inserted in the pockets formed by the loops. Preferably, it is a so-called "two-way stretch" material. The size of the loops is such as to hold a tool firmly against the surface of the backing member with sufficient frictional resistance to removal that the user has to grip the tool and positively remove it from its storage pocket. Thus, the ordinary body movements and position of the user will not cause a tool to become displaced unintentionally.

It will be recognized that the size of the individual loops or pockets will be designed to accommodate the size and type of tool the user is expected to need to carry. Various types of work and, in some cases, various phases of the work may well require tools which generally are larger or smaller than those for other jobs. The individual pockets for each tool caddy can be designed to accommodate this. Since the tool caddies are quickly interchangeable accessories to the belt itself, this can easily be accommodated. For certain types of activities, it may be desirable to provide pockets of different sizes on each side or tool caddies with more than one size of pocket or loop. The ability to substitute whole groups of tools simply by replacing one tool equipped tool caddy with another having different tools is a very important benefit of this invention.

It is also a major advantage to both the manufacturer and merchandiser of tool belts to be able to adapt the belts to the customer's particular needs at the point of sale, utilizing a single belt design and a selection of tool caddies which function as interchangeable belt accessories.

This invention not only provides a better system for storing the tools and making them capable of quick visual identification, it also provides a visual, effective and continuous inventory of the tools. This, materially reduces loss, a common and costly result of use of the current designs of tool carrying equipment of this type. It does this by, for the first time, providing a system for organizing, displaying and transporting a significant number of tools where they are immediately and constantly accessible.

Having described a preferred embodiment of my invention and a modification thereof, it will be recognized that other modifications can be made without departing from the principles of the invention. Such modifications are to be considered as included in the hereinafter appended claims, unless these claims, by their language, expressly state otherwise.

I claim:

1. A belt type tool holder of the type to be worn around the waist of the user, said tool holder having a belt to be worn around the user's waist; a tool caddy, said caddy having a backing member of approximately the width of the belt and a length of less than one half of the length of the belt, said backing member having a back face which faces the belt; a web formed into a plurality of closely spaced loops and means securing said web to said backing member at both web ends and between each pair of adjacent loops, said web being of an elastic material whereby each loop can be individually stretched to tension it when a tool is inserted partially through the loop, means for detachably securing said backing member to said belt whereby the tool caddy and the tools it is supporting can be removed together by detachment of the backing member from the belt.

2. A belt type tool holder as described in claim 1 wherein said detachable means for securing said tool caddy to said belt are interengaging snap fasteners on said belt and each end of the backing member.

3. A belt type tool holder as described in claim 2 wherein a pair of interengaging patches of detachably interengaging fastener tape are secured to said belt and backing member respectively intermediate said fasteners.

4. A belt type tool holder as described in claim 1 wherein said means for detachably securing said backing member to said belt are panels of detachably interengaging fastener tape extending the length of said backing member.

5. A belt type tool holder of the type to be worn around the waist of the user, said tool holder having a belt; a tool caddy, said caddy having a backing member of approximately the width of the belt and of a length approximately one fourth of the length to one half the belt, separable anchor means, one of which is secured to the belt and the other to said backing member for detachably securing said tool caddy to said belt, a elastic web secured at a plurality of spaced intervals to said backing member to form outwardly extending tool holding loops each of a size to receive, be stretched by and press against a single tool when the tool is inserted through the loop.

6. A belt type tool holder as described in claim 5 wherein said separable anchor means are snap fasteners.

7. A belt type tool holder as described in claim 5 wherein said separable anchor means are lengths of interengaging fastener tape one length of which is secured to said belt and the other to said backing member.

* * * * *